US010370862B1

(12) United States Patent
Humann

(10) Patent No.: US 10,370,862 B1
(45) Date of Patent: Aug. 6, 2019

(54) ADHESIVE APPLICATION APPARATUS FOR TILES

(71) Applicant: Sergei Humann, Winnipeg (CA)

(72) Inventor: Sergei Humann, Winnipeg (CA)

( * ) Notice: Subject to any disclaimer, the term of this patent is extended or adjusted under 35 U.S.C. 154(b) by 0 days.

(21) Appl. No.: 16/191,080

(22) Filed: Nov. 14, 2018

(30) Foreign Application Priority Data

Apr. 17, 2018 (CA) ..... 3001811

(51) Int. Cl.
*B05C 5/00* (2006.01)
*E04F 21/20* (2006.01)
*E04F 21/16* (2006.01)

(52) U.S. Cl.
CPC ..... *E04F 21/163* (2013.01); *B05C 5/004* (2013.01); *E04F 21/20* (2013.01)

(58) Field of Classification Search
None
See application file for complete search history.

(56) References Cited

U.S. PATENT DOCUMENTS 2,329,378 A * 9/1943 Kuehner ..... B05C 3/18 118/413
2,946,110 A * 7/1960 Lang ..... B28B 11/041 425/117
3,138,843 A * 6/1964 Gory ..... B28B 11/04 118/415
3,416,947 A * 12/1968 Hall ..... B28B 11/04 264/259
3,942,923 A * 3/1976 Binion ..... B28B 1/084 425/64
4,967,689 A * 11/1990 Wittmann ..... B05C 3/18 118/413
9,234,359 B2 1/2016 Bourelle

FOREIGN PATENT DOCUMENTS

| | | |
|---|---|---|
| CN | 2866710 | 2/2007 |
| CN | 103938841 | 7/2014 |
| CN | 106869459 | 6/2017 |
| FR | 1442986 | 6/1966 |

* cited by examiner

*Primary Examiner* — Charles Capozzi
(74) *Attorney, Agent, or Firm* — Ryan W. Dupis; Ade + Company Inc.; Kyle E. Satterthwaite

(57) ABSTRACT

An apparatus for applying adhesive to a tile comprises a container for receiving the adhesive to be applied to the tile. The container defines a downwardly-opening orifice through which the adhesive is enabled to pass out of the container. The apparatus further features a substantially horizontally extending track coupled below the container and adapted for supporting the tile in sliding movement underneath the orifice from an inlet side of the orifice and past the orifice to an outlet side thereof so that the adhesive received in the container passes out of the orifice and onto the tile.

16 Claims, 9 Drawing Sheets

ADHESIVE APPLICATION APPARATUS FOR TILES

This application claims foreign priority benefits from Canadian Patent Application Ser. No. 3,001,811 filed Apr. 17, 2018.

FIELD OF THE INVENTION

The present invention relates generally to an apparatus for applying adhesive, such as mortar or grout, to a tile, and more particularly to such an apparatus which includes a container for receiving the adhesive, which container defines a downwardly-opening orifice through which the adhesive can exit the container, and a track connected to the container for supporting the tile at an adjacent location to the orifice to receive the adhesive.

BACKGROUND

A method of installing tiles onto a surface generally comprises the steps of applying adhesive to an adhesive-receiving face of a respective tile and subsequently locating the tile with adhesive applied thereto on a target surface. Traditionally, most tile installers apply the adhesive to the tiles by hand. More specifically, this traditional manual application method comprises transferring the adhesive directly from its storage container to each tile and subsequently spreading the adhesive uniformly across the face of the tile with a trowel. This adhesive application step is time consuming and thus considerably prolongs installation.

U.S. Pat. No. 9,234,359 to Bourelle discloses a tile floor adhesive spreading and leveling device adapted for applying adhesive directly to a target surface in rolling movement of the apparatus across the surface. Once the adhesive has been applied, the tiles are laid on the target surface with the adhesive thereon. However, the arrangement of Bourelle is designed specifically for tiling floor surfaces and thus has limited use.

CN 10398841 to Risheng appears to disclose an arrangement for applying adhesive to a tile which comprises a container supported over a conveyor belt. Thus tiles to receive adhesive are placed on the conveyor belt which is operated to move the tile sitting stationary relative to the conveyor past the container to receive adhesive. However, an arrangement like that in Risheng includes complex mechanical components and is not suitably portable for use by an individual installing tiles on-site.

SUMMARY OF THE INVENTION

According to an aspect of the invention there is provided an apparatus for applying adhesive to a tile comprising:

a container for receiving the adhesive to be applied to the tile;

the container defining a downwardly-opening orifice through which the adhesive is enabled to pass out of the container; and a substantially horizontally extending track coupled below the container and adapted for supporting the tile in sliding movement underneath the orifice from an inlet side of the orifice and past the orifice to an outlet side thereof so that the adhesive received in the container passes out of the orifice and onto the tile.

This arrangement, unlike the prior art arrangements, is relatively simply and can be made suitably portable for use on-site to apply adhesive directly to tiles for subsequent placement on any type and orientation of target surface, which can be a floor or a wall surface.

Preferably the track extends from a location underneath the container in a substantially horizontal direction beyond the container on the outlet side of the orifice so that the track defines a tile supporting surface on the outlet side for supporting the tile until the tile is retrieved from the apparatus.

In the illustrated arrangement the track extends beyond the container on the inlet side of the orifice for aligning the tile with the orifice before passing across the orifice.

Preferably the track defines a stationary substantially horizontally oriented surface below the container.

In the illustrated arrangement the track comprises a pair of guide rails extending in a direction of the sliding movement and disposed in transversely spaced condition to one another.

Preferably the track includes a pair of opposite upstanding guide surfaces to confine movement of the tile transversely of a direction of the sliding movement.

Preferably the container includes a fixed peripheral wall supported in fixed location and a movable wall which is displaceable relative to the fixed peripheral wall in a transverse direction to the sliding movement for adjusting a width of the orifice for tiles having different widths.

In the illustrated arrangement the fixed peripheral wall has a leading wall portion on the inlet side of the orifice and a trailing wall portion on the outlet side of the orifice which are spaced from one another in the direction of sliding movement, the leading wall portion and the trailing wall portion each have a fixed width, and the movable wall is displaceable in the transverse direction across the leading wall portion and the trailing wall portion for adjusting the width of the orifice.

In the illustrated arrangement the movable wall includes a cut-out shaped to receive a fixed length trowel blade mounted to the trailing wall portion in transverse orientation relative to the direction of sliding movement so that the fixed length trowel blade is usable for different widths of the orifice.

In the illustrated arrangement the container carries transversely extending guide surfaces on the inlet side and the outlet side of the orifice on the fixed peripheral wall of the container for supporting the movable wall of the container in sliding movement thereof across the fixed peripheral wall in the transverse direction.

Preferably the transversely extending guide surfaces are located closer to an upper end of the fixed container wall than to a lower end thereof.

In the illustrated arrangement the track includes a fixed track portion supported in fixed location and a relocatable track portion displaceable relative to the fixed track portion in said transverse direction to the sliding movement.

Preferably the movable wall of the container and the relocatable track portion are carried on a common mounting member arranged for movement in the transverse direction so that the movable wall and the relocatable track portion are maintained in fixed relation to one another during said movement.

In the illustrated arrangement the mounting member is disposed underneath the relocatable track portion and the movable wall which are mounted on top of the mounting member.

In the illustrated arrangement the mounting member is threadably coupled to a rod which is supported for rotation around a transverse axis below the container and the track such that the rotation of the rod acts to displace the movable wall and the relocatable track portion in the transverse direction.

In the illustrated arrangement the mounting member carries clamps at longitudinally spaced locations which are adapted for securing the mounting member in fixed location relative to the fixed peripheral wall of the container.

In the illustrated arrangement the container defines at least one slot in a peripheral wall of the container forming a respective handle for receiving a hand of a user.

In the illustrated arrangement the container and track are carried on a frame including collapsible legs for resting on a support surface.

According to another aspect of the invention there is provided an apparatus for applying adhesive to a tile comprising:

a container for receiving the adhesive to be applied to the tile;

the container defining a downwardly-opening orifice through which the adhesive is enabled to pass out of the container;

a substantially horizontally extending track coupled below the container and adapted for supporting the tile in sliding movement underneath the orifice from an inlet side of the orifice and past the orifice to an outlet side thereof so that the adhesive received in the container passes out of the orifice and onto the tile;

the container including a fixed peripheral wall supported in fixed location and a movable wall which is displaceable relative to the fixed peripheral wall in a transverse direction to the sliding movement for adjusting a width of the orifice for tiles having different widths;

the track including a fixed track portion supported in fixed location and a relocatable track portion displaceable relative to the fixed track portion in said transverse direction to the sliding movement;

wherein the movable wall of the container and the relocatable track portion are interconnected so as to be maintained in fixed relation to one another during movement in the transverse direction.

BRIEF DESCRIPTION OF THE DRAWINGS

The invention will now be described in conjunction with the accompanying drawings in which.

In the drawings like characters of reference indicate corresponding parts in the different figures.

DETAILED DESCRIPTION

The accompanying figures show an apparatus 10 for applying adhesive to a tile (though neither the adhesive nor tile are shown).

Figure 1:
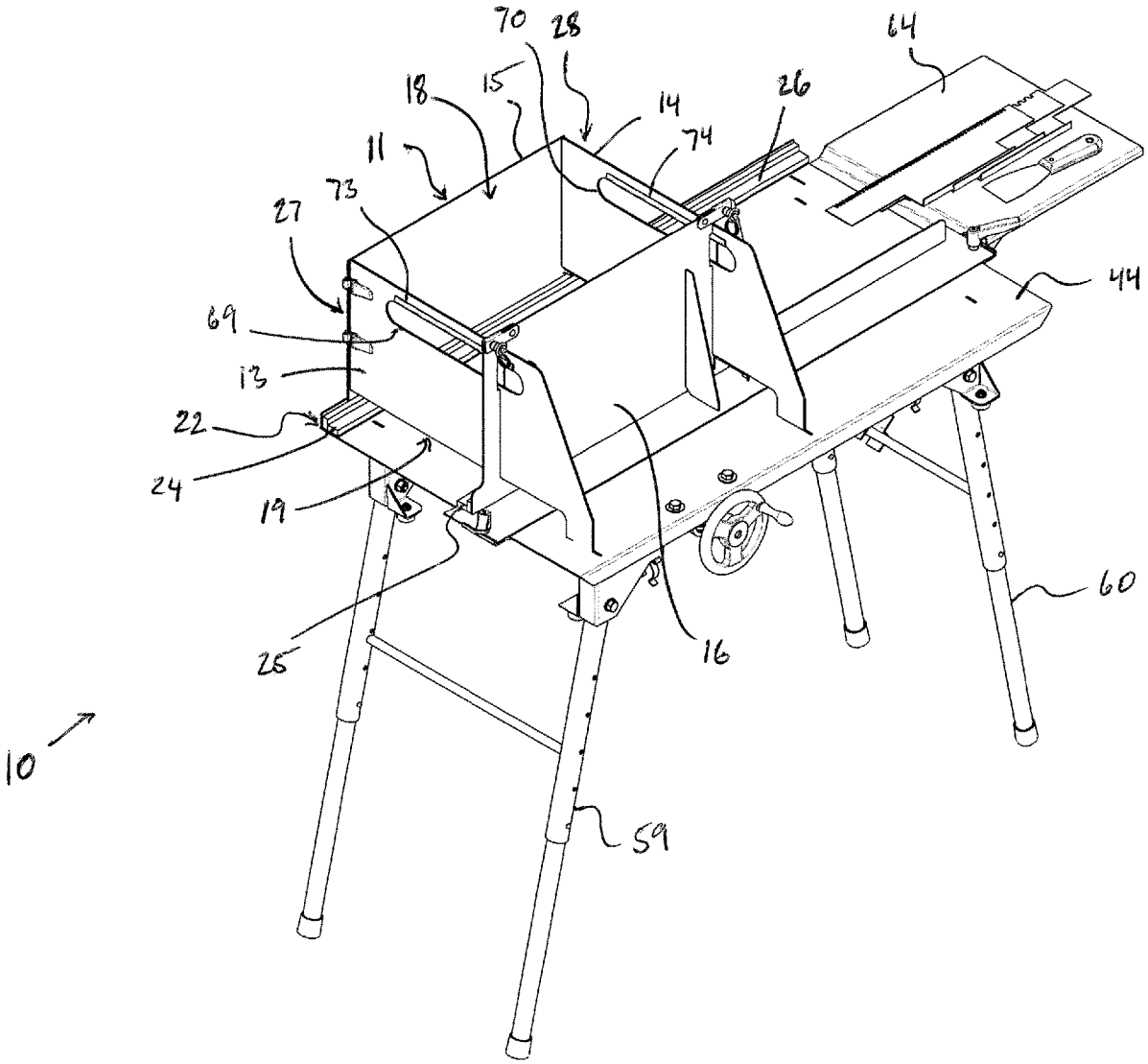
FIG. 1 is a top perspective view on an inlet side of an arrangement of apparatus for applying adhesive to a tile according to the present invention.

Referring to FIG. 1, the apparatus 10 comprises a container 11 formed from a series of planar upright panels indicated at 13 through 16 which are arranged in a rectangular configuration to form a rectangular peripheral container wall. Thus the container 13 is open at its top 18 and defines at its bottom a downwardly-facing orifice 19 collectively formed by bottom edges of the panels 13-16. It will be better appreciated shortly that the container 11 receives the adhesive through its open top 18 that is subsequently to be applied by passing through the orifice 19 to a surface of a respective tile, so that the tile with the adhesive can subsequently be installed on a target surface such as a wall or a floor surface.

The apparatus 10 further includes a track 22 located beneath the container that is formed by a pair of parallel longitudinally extending guide rails 24, 25 which are spaced laterally transversely apart. The rails 24, 25 which are generally L-shaped in transverse cross-section collectively define a stationary substantially horizontally oriented planar guide surface 26 spaced below the orifice 19 to support the tile in a generally horizontal orientation passing across the orifice 19 from an inlet side 27 to an outlet side 28 thereof in sliding movement along the rails 24, 25 so that the tile moves past the container 11 holding the adhesive, and as the tile is displaced relative to the fixedly located container 11 a thickness of the adhesive contained therein is deposited onto an upwardly-facing adhesive-receiving surface of the tile.

Figure 2:
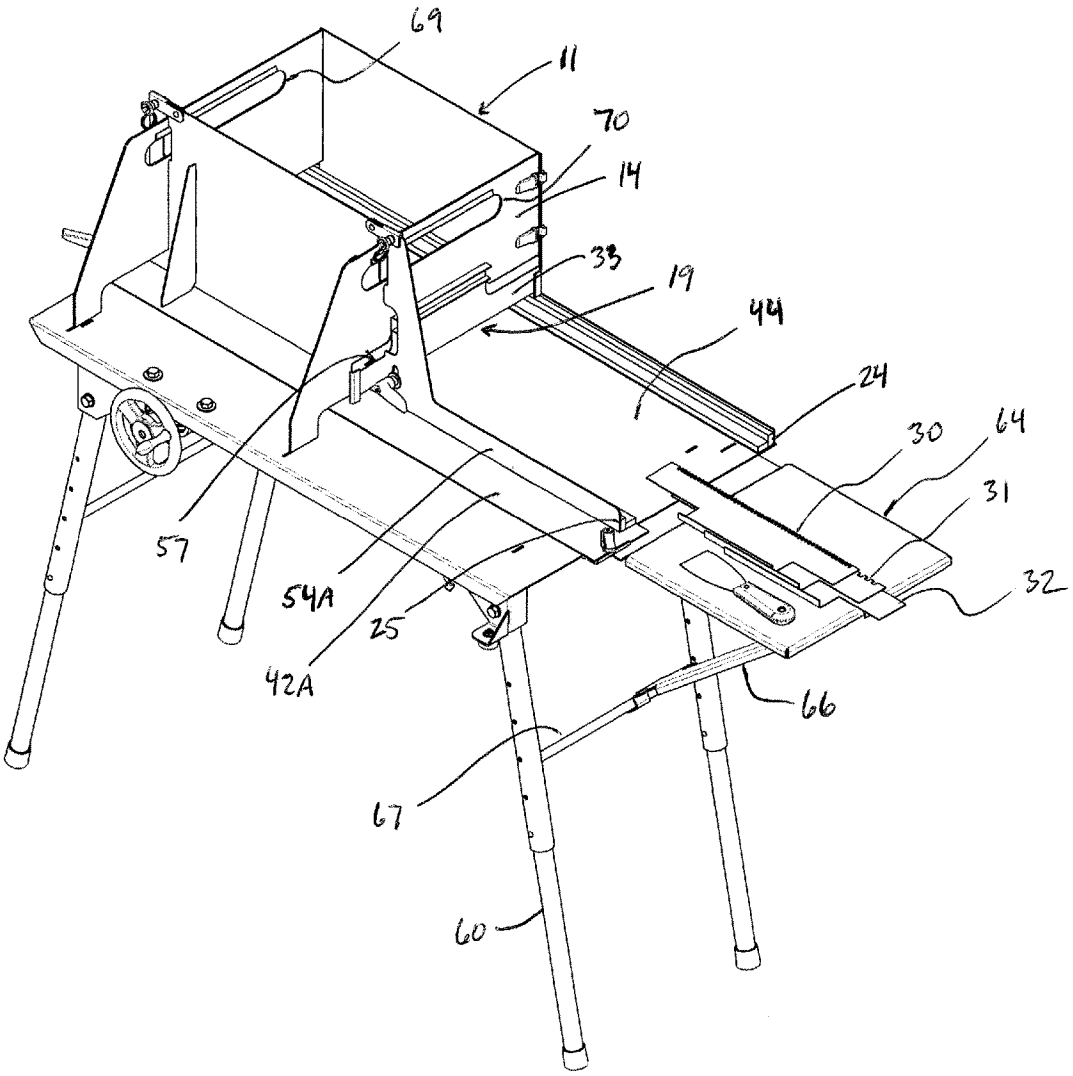
FIG. 2 is a top perspective view on an outlet side of the arrangement of FIG. 1.

Referring to FIG. 2, a conventional trowel blade such as that indicated at 30, 31 and 32 is individually attachable at mounting location defined by mounted trowel blade 33 to a trailing wall portion of the container 11 that is defined by trailing end panel 14 so that as the tile exits the space immediately below the orifice 19 the trowel blade acts to uniformly spread the adhesive across the upper surface of the tile.

Figure 3:
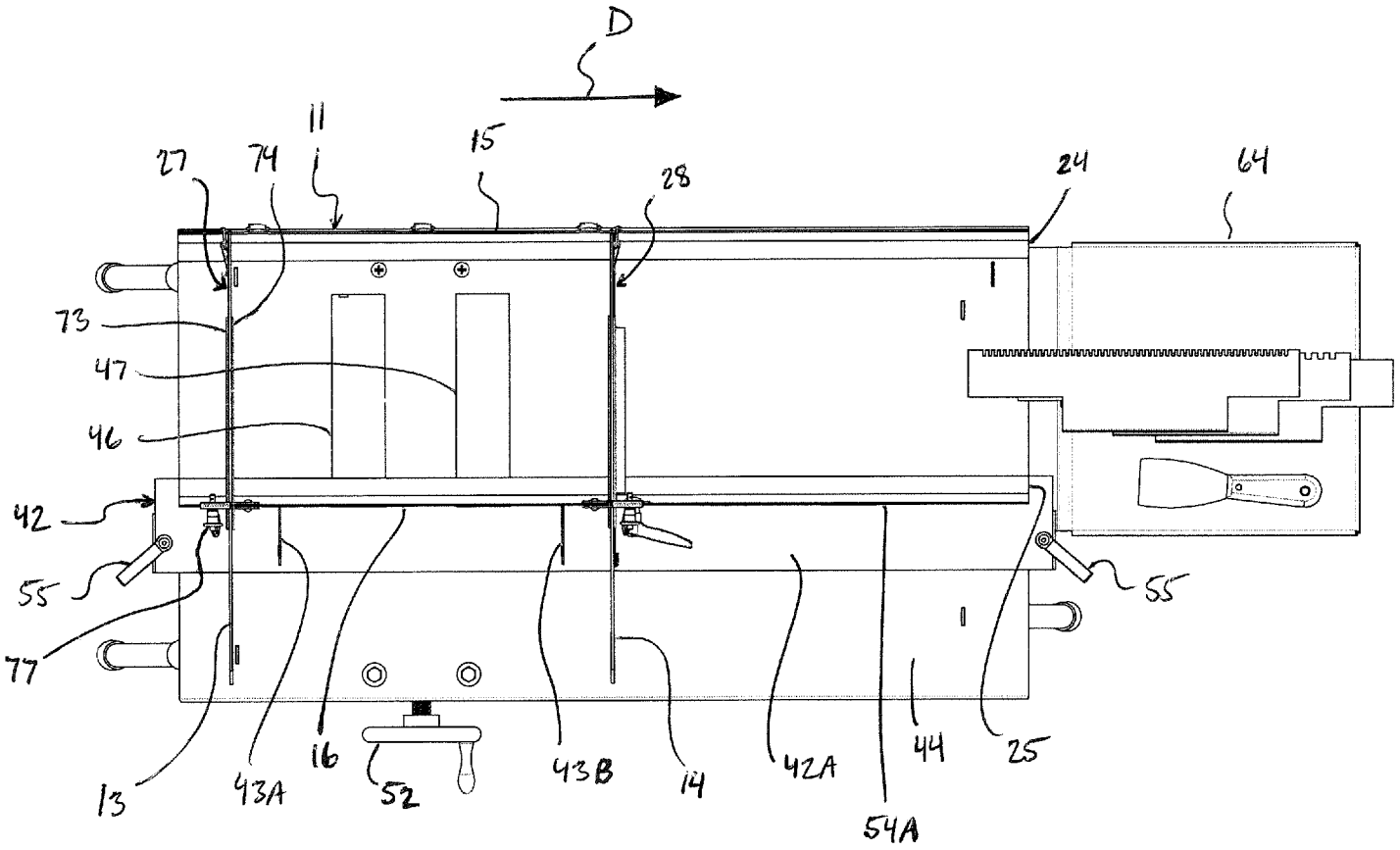
FIG. 3 is a top plan view of the arrangement of FIG. 1.

The rails 24, 25 are oriented in a direction of sliding movement indicated at D in FIG. 3 as the rails define the path of sliding movement traversed by the respective tile passing through the apparatus 10. The rails 24, 25 are disposed at a location underneath the container 11 adjacent the orifice 19 but also extend therefrom past the outlet side 28 of the container where there is no container so as to define a tile pick-up surface for supporting the respective tile which has just received adhesive until the tile is removed from the apparatus to be installed on the target surface.

Tiles are moved through the apparatus 10 along the rails 24, 25 by displacing an already inserted tile which is located beneath the orifice 19 by inserting another tile, which is fresh without adhesive, into the adhesive-depositing area. That is, to begin using the apparatus 10, first a tile is inserted into the apparatus 10 beneath the orifice 19, and then the adhesive is added to the container 11 so that it is the already inserted tile which supports the adhesive in the container above the tile. In order to remove the inserted tile, a fresh tile is inserted at the inlet side 27 of the apparatus, by which action the already inserted tile is moved out from beneath the orifice to the outlet side 28 ready for pick-up while the adhesive is retained within the container 11 by the freshly inserted tile. As such, the rails 24, 25 also extend past the inlet side 27 of the container to provide a leading guide surface to allow a user to more easily align the next tile to be inserted into the apparatus with a rear end of the already inserted tile. A length of the leading guide surface in the direction of sliding movement past a leading wall portion of the container 11 defined by leading end panel 13 is significantly smaller than on a length of the rails protruding on the outlet side 28 of the container to define the trailing pick-up surface as the leading guide surface is simply for prepping the next tile to be inserted by aligning same with the orifice 19 while the pick-up surface has to support a whole tile until it is retrieved by a user.

As more clearly shown in FIG. 4, a bottom blade edge 33A of the mounted trowel blade 33 is spaced below the orifice 19 which in the illustrated arrangement lies in a plane parallel to the horizontal guide surface 26 of the track 22 and thus is identifiable in FIG. 4 by the bottom edge of leading end panel 13. Thus the tiles passing across the orifice 19 exit from underneath the container 11 with a uniform thickness of adhesive, as the trowel blade edge 33A is spaced at a height above the guide surface 26 by an amount greater than a thickness of the respective tile, with the remaining adhesive to-be-applied retained generally within the container 11 by the mounted trowel blade 33. As the tiles pass from the inlet side 27 to the outlet side 28, the excess adhesive supported by the already-inserted tile tends to move with the tile on its path towards the outlet side 28 of the orifice 19, but the excess is retained by the trailing end panel 14 and spills over onto the freshly inserted tile replacing that which has exited from underneath the container 11. Thus, even though the bottom edge of the leading end panel 13 is spaced above the horizontal guide surface 26 by an amount greater than a thickness of adhesive to be applied to the tiles, the adhesive received in the container 11 does not escape between the already inserted tile and the bottom edge of the leading end panel 13 as the excess adhesive tends to be pulled towards the outlet side 28 of the container. Furthermore, when adding adhesive into the container 11, it can be filled nearer the outlet side 28 so as to reduce likelihood of inadvertent escape beneath the bottom edge of the leading end panel 13.

Figure 4:
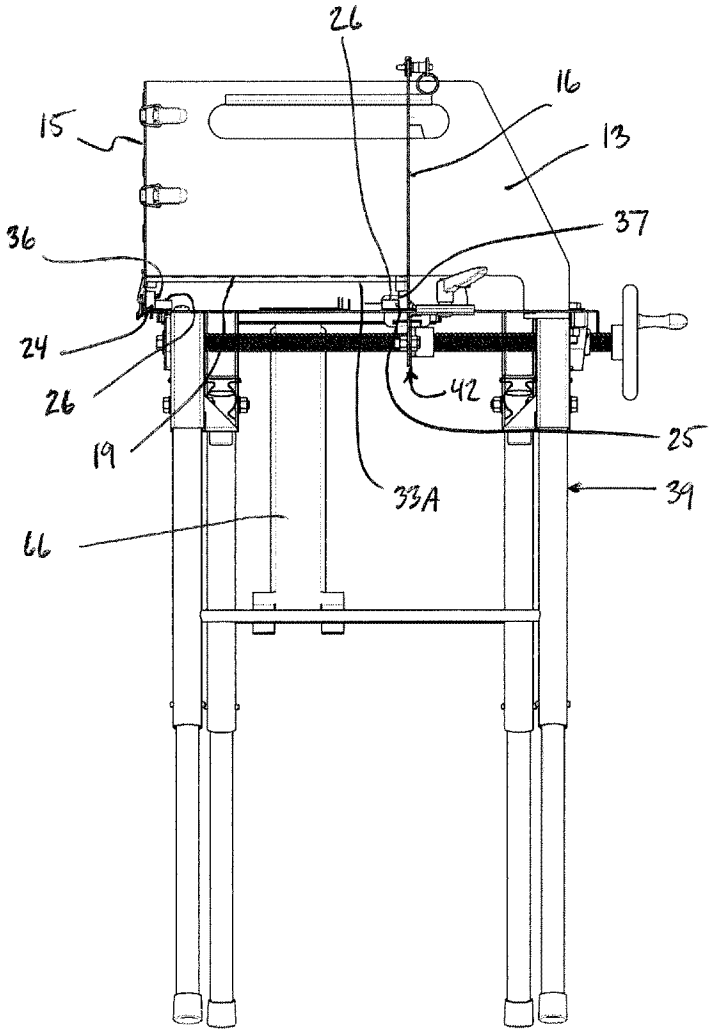
FIG. 4 is an elevational view on an inlet end of the arrangement of FIG. 1.
Figure 5:
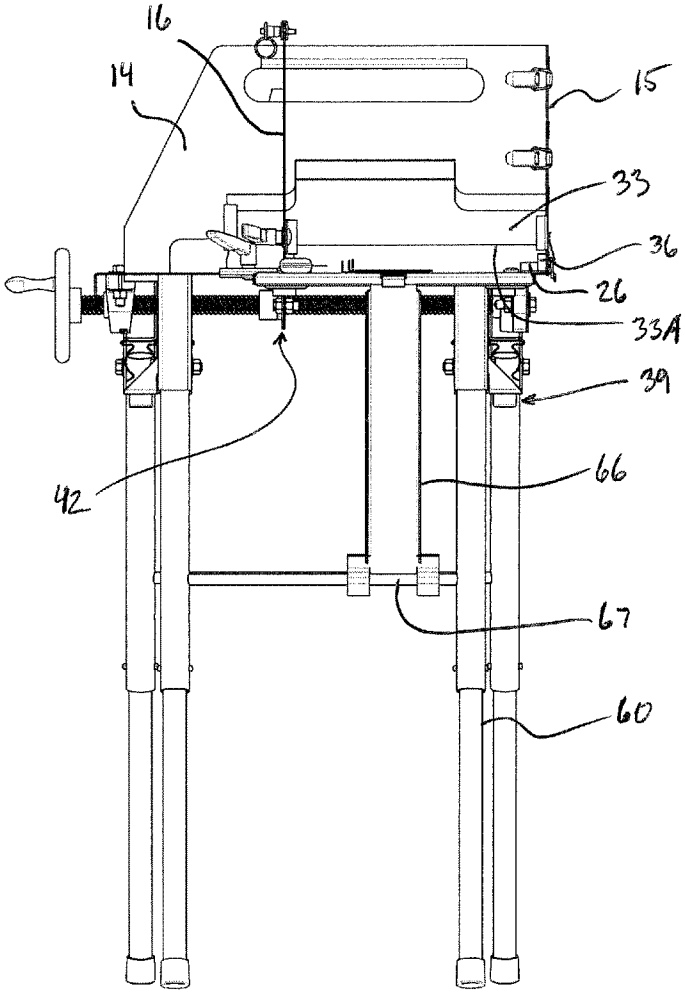
FIG. 5 is an elevational view on an opposite outlet end of the arrangement of FIG. 1.

Referring still to FIG. 4 and also to FIG. 5, in addition to defining a substantially horizontally oriented planar guide surface 26, the rails 24, 25 also define a pair of upstanding guide surfaces 36, 37, one on either side of the horizontal tile support surface 26, which stand perpendicularly upwardly therefrom in cooperative opposing relation to one another to confine movement of the tile transversely of the direction of sliding movement. The rails 24, 25 are arranged at a laterally spaced distance from one another which corresponds to the width of the tiles being fed into the apparatus 10, and thus the opposite upstanding guide surfaces 36, 37 are spaced apart by a distance slightly larger than the respective tile width so that there is virtually no transverse movement as the respective tile is passed from the inlet side to the outlet side of the orifice 19.

Tiles are manufactured in various widths and thus both the track 22 and the orifice 19 are each configured with adjustable width so that the apparatus 10 can receive tiles having different widths. In regard to the orifice 19 which is defined by the container 11, the leading end panel 13, the trailing end panel 14, and one of the side panels 15 collectively define a fixed peripheral container wall which is supported in a fixed location with respect to a frame 39 of the tile applicator apparatus 10 that is adapted for resting on a support surface of a worksite, and the opposite side panel 16 defines a movable container wall which is that part of the container arranged for movement relative to the fixed container wall in order to adjust the width of the orifice. More specifically, each of the leading and trailing end panels 13, 14 have a fixed width corresponding to a maximum width of tile that can be received by the apparatus 10, and the movable side panel 16 which spans between the leading and trailing end panels 13, 14 is displaceable across the end panels 13, 14 in a laterally transverse direction relative to the sliding movement of the tiles through the apparatus 10 for adjusting the width of the orifice.

Figure 6:
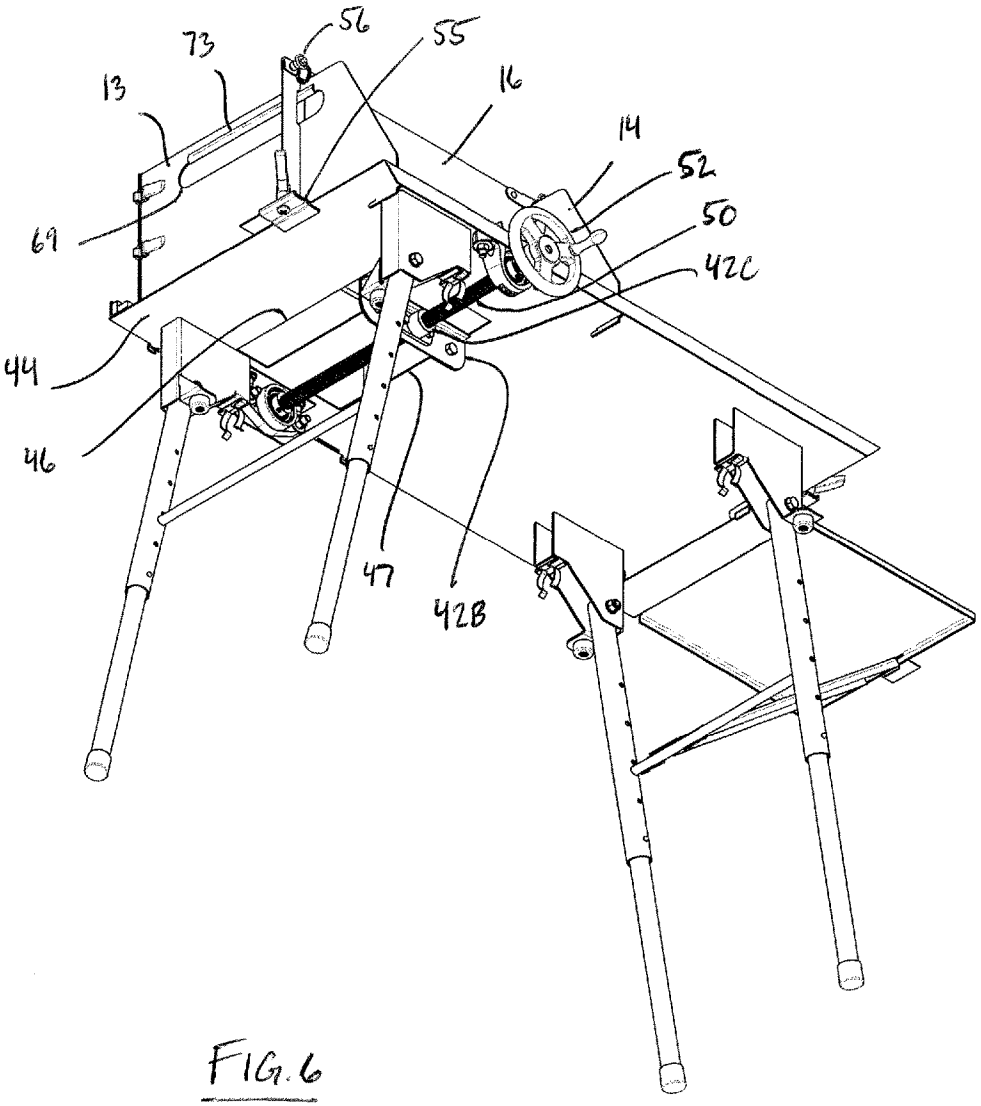
FIG. 6 is a bottom perspective view of the arrangement of FIG. 1.
Figure 7:
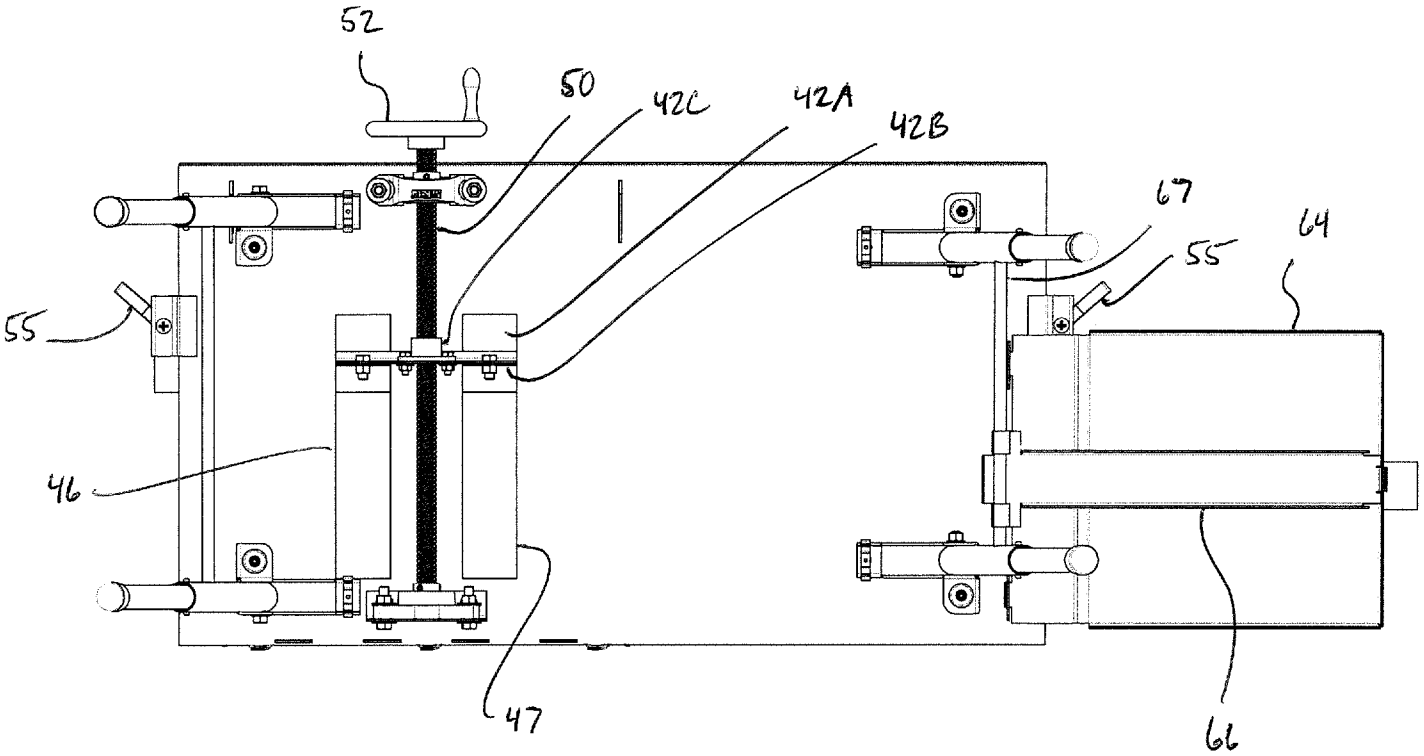
FIG. 7 is a bottom plan view of the arrangement of FIG. 1.

Referring to FIGS. 3, 6 and 7, the movable container wall panel 16 is carried on a mounting member 42 in the form of a planar base strip 42A disposed on top of and oriented parallel to a tabletop 44 of the apparatus 10. The movable side panel 16 is further braced on the base strip 42A by a pair of upstanding gussets 43A and 43B connected along a vertical edge to the side panel 16 and along their bottom edge to the base strip 42A. The base strip 42A is connected through a pair of laterally extending slots 46, 47 formed in the tabletop 44 with a bracket 42B which is located beneath the tabletop 44. The mounting member 42 includes a sleeve 42C supported on the bracket 42B connected to the underside of the base strip 42A, with a threaded inner surface of the sleeve that mates with a threaded rod 50 supported for rotation around its rod axis which is oriented laterally of the sliding movement of the tiles through the apparatus 10. At one end of the rod 50 is provided a crank handle 52, and thus by rotation of the rod 50 the mounting member 42 is threadably displaced axially of the rod, so that a position of the side panel 16 located above the tabletop 44 can be adjusted relative to the fixed panels 13-15.

In regard to width-adjustment of the track 22, the rail 24 is fixedly located relative to the apparatus frame 39 so as to define a fixed track portion, and the rail 25 defines a relocatable track portion which is movable relative to the fixed-location rail 24 in the lateral width direction. As shown more clearly in FIG. 3, the relocatable rail 25 is disposed along an inner side of the movable side panel 16 which includes an extended portion 54A on the outlet side of the trailing end panel 14 and is connected to the base strip 42A of the mounting member. Thus the relocatable rail 25 is also carried on the mounting member 42 so that the movable side panel 16 and the relocatable rail 25 are interconnected by the mounting member 42 and are displaceable in the lateral direction together, in fixed relation to one another, and on a common mounting member.

When the movable side panel 16 and relocatable rail 25 are placed at the desired width from the opposite side of the container and track, the base strip 42A carries clamps 55 adapted for anchoring the base strip 42A in fixed location to the tabletop 44 so that the mounting member 42 is secured in fixed relation to the frame 39 of the apparatus.

Even though the width of the orifice 19 and track 22 can be adjusted, the apparatus 10 is adapted to enable use of a fixed length trowel blade sized to correspond to the maximum width of tile receivable by the apparatus, so that a common trowel blade can be used for all widths of tile without having to interchange different widths of blades. As such, as more clearly shown in FIG. 2 the movable side panel 16 which in the illustrated arrangement extends beyond trailing end panel 14 defines a cut-out 57 on an exterior of the trailing end panel 14 shaped to receive a cross-sectional profile of the mounted trowel blade 33 that is received at the mounting location externally of the container 11.

Figure 8:
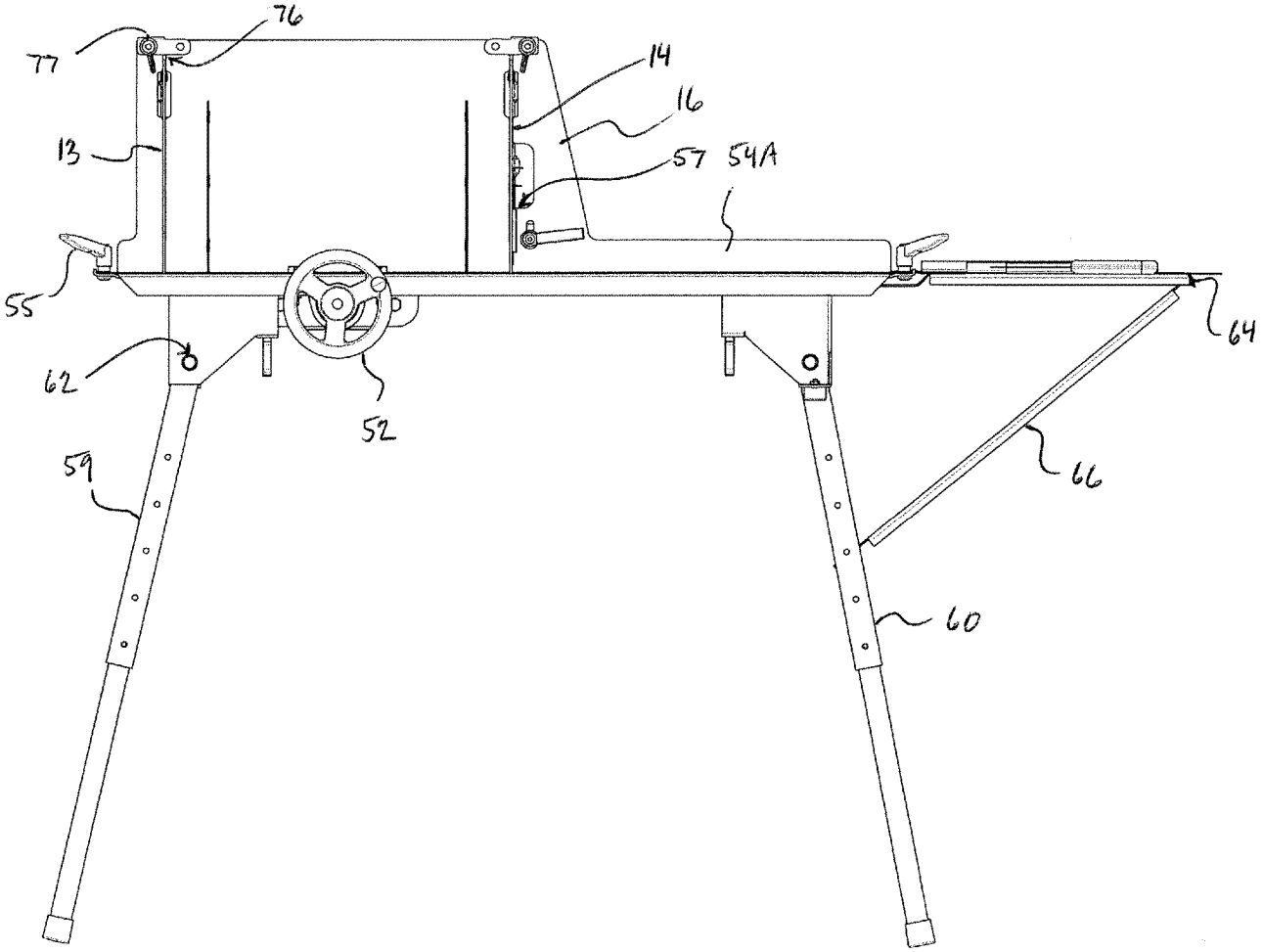
FIG. 8 is a side elevational view of the arrangement of FIG. 1.
Figure 9:
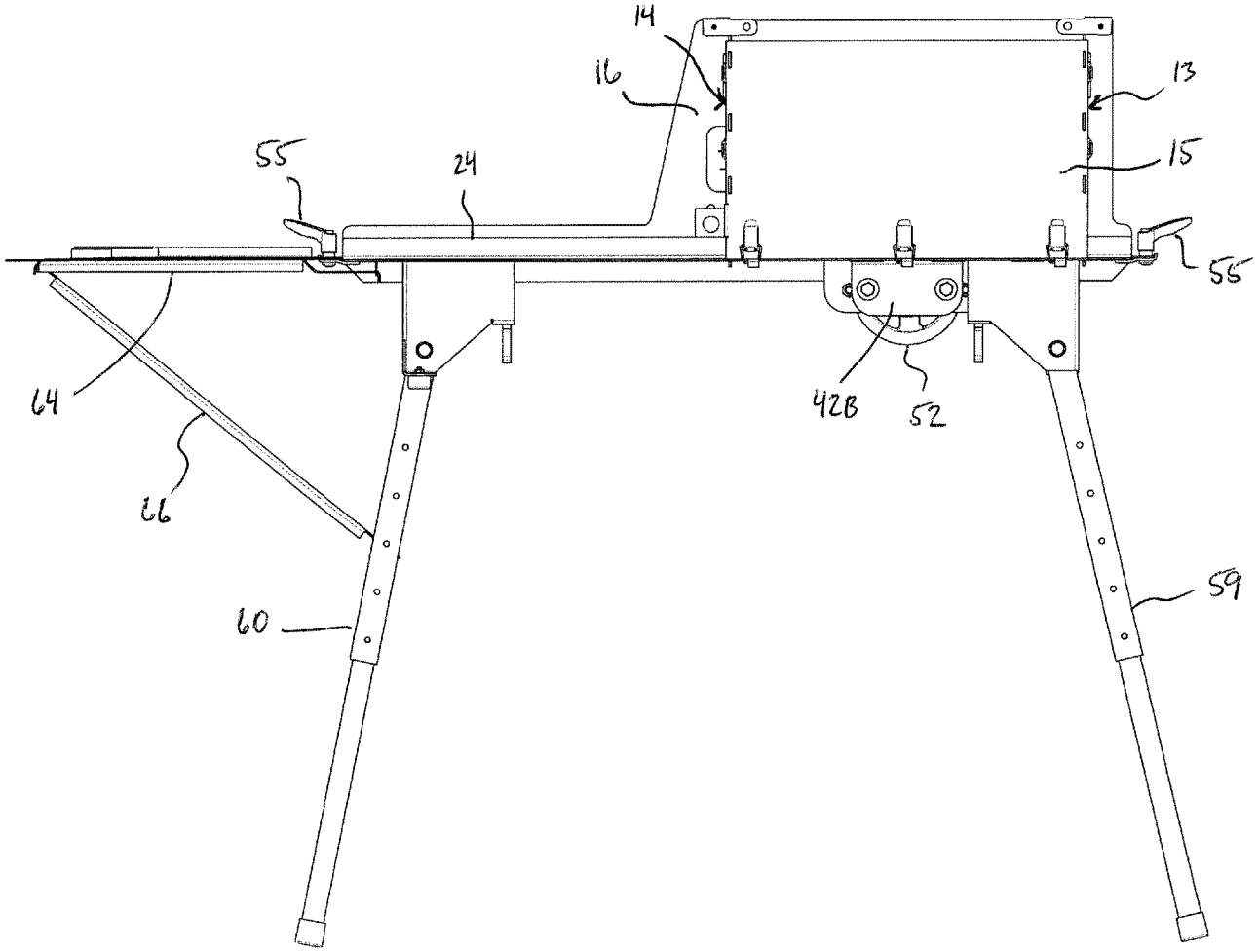
FIG. 9 is an opposite side elevational view of the arrangement of FIG. 1.

Referring to FIGS. 8 and 9, the apparatus frame 39 includes two pairs of collapsible legs 59, 60 each pair of which is foldable about a laterally transverse folding axis defined at 62 so that the frame 39 can be compacted for transport. The frame 39 supports the tabletop 44 and includes a collapsible extension surface 64 which is supported in a cantilevered working position by strut 66 which removably attaches to a cross-member 67 of collapsible leg pair 60. This additional surface provided by the extension 64 can be used to support articles, such as replacement trowel blades like shown in the figures, at a location which does not obstruct movement of the movable side panel 16 and relocatable rail 25.

The container 11 also includes a pair of hand slots 69, 70 defined in the leading and trailing end panels 13, 14, as more clearly shown in FIG. 1, which form handles for receiving a user's hand. Thus the portable apparatus 10 can be held at the container 11.

Still referring to FIG. 1 but also to FIG. 3, at upper ends of the hand slots 69, 70 the container 11 includes upturned flanges 73, 74, one on an outer side of the respective container end panel and the other on an inner side thereof, each extending laterally transversely of the container and projecting slightly from the respective planar face of the panel. An outer surface of each of the flanges 73, 74 provides a sliding contact surface supporting the movable side panel 16 of the container in its transverse movement across the end panels 13, 14 and thus the flanges 73, 74 act as guide rails for guiding the transverse movement of the movable side panel 16 near its upper end. As more clearly shown in FIG. 8 the movable side panel 16 defines vertically elongated slits 76 which are open at their tops and closed at their bottom ends at a location spaced above the rails 24, 25. The slits each receive one of the end panels 13 and 14. Reinforcing brackets 77 are provided respectively at a position on the movable side panel 16 above a top edge of the respective end panel 13, 14 to bridge the corresponding slit 76 so as to rigidify the side panel 16 on opposite sides of the respective slit 76.

The scope of the claims should not be limited by the preferred embodiments set forth in the examples but should be given the broadest interpretation consistent with the specification as a whole.

The invention claimed is:

1. An apparatus for applying adhesive to a tile comprising:

a container for receiving the adhesive to be applied to the tile;

the container defining a downwardly-opening orifice through which the adhesive is enabled to pass out of the container;

a substantially horizontally extending track coupled below the container and adapted for supporting the tile in sliding movement underneath the orifice from an inlet side of the orifice and past the orifice to an outlet side thereof so that the adhesive received in the container passes out of the orifice and onto the tile;

the container including a fixed peripheral wall supported in fixed location and a movable wall which is displaceable relative to the fixed peripheral wall in a transverse direction to the sliding movement for adjusting a width of the orifice for tiles having different widths;

the track including a fixed track portion supported in fixed location and a relocatable track portion displaceable relative to the fixed track portion in said transverse direction to the sliding movement;

wherein the movable wall of the container and the relocatable track portion are interconnected so as to be maintained in fixed relation to one another during movement in the transverse direction.

2. The apparatus of claim 1 wherein the track extends from a location underneath the container in a substantially horizontal direction beyond the container on the outlet side of the orifice so that the track defines a tile supporting surface on the outlet side for supporting the tile until the tile is retrieved from the apparatus.

3. The apparatus of claim 1 wherein the track defines a stationary, substantially horizontal-oriented surface below the container.

4. The apparatus of claim 3 wherein the track comprises a pair of guide rails extending in a direction of the sliding movement and disposed in transversely spaced condition to one another.

5. The apparatus of claim 1 wherein the track includes a pair of opposite upstanding guide surfaces to confine movement of the tile transversely of a direction of the sliding movement.

6. The apparatus of claim 1 wherein the fixed peripheral wall has a leading wall portion on the inlet side of the orifice and a trailing wall portion on the outlet side of the orifice which are spaced from one another in the direction of sliding movement, the leading wall portion and the trailing wall portion each having a fixed width, and the movable wall being displaceable in the transverse direction across the leading wall portion and the trailing wall portion for adjusting the width of the orifice.

7. The apparatus of claim 1 wherein the movable wall includes a cut-out shaped to receive a fixed length trowel blade mounted to the trailing wall portion in transverse orientation relative to the direction of sliding movement so that the fixed length trowel blade is usable for different widths of the orifice.

8. The apparatus of claim 1 wherein the movable wall of the container and the relocatable track portion are carried on a common member arranged for said movement in the transverse direction.

9. The apparatus of claim 8 wherein the member is disposed underneath the relocatable track portion and the movable wall which are mounted on top of the member.

10. The apparatus of claim 8 wherein the member is threadably coupled to a rod which is supported for rotation around a transverse axis below the container and the track such that the rotation of the rod acts to displace the movable wall and the relocatable track portion in the transverse direction.

11. The apparatus of claim 10 wherein the member carries clamps at longitudinally spaced locations which are adapted for securing the member in fixed location relative to the fixed peripheral wall of the container.

12. The apparatus of claim 1 wherein the container carries transversely extending guide surfaces on the inlet side and the outlet side of the orifice on the fixed peripheral wall of the container for supporting the movable wall of the container in sliding movement thereof across the fixed peripheral wall in the transverse direction.

13. The apparatus of claim 12 wherein the transversely extending guide surfaces are located closer to an upper end of the fixed container wall than to a lower end thereof.

14. The apparatus of claim 1 wherein the track extends beyond the container on the inlet side of the orifice for aligning the tile with the orifice before passing across the orifice.

15. The apparatus of claim 1 wherein the container defines at least one slot in a peripheral wall of the container forming a respective handle for receiving a hand of a user.

16. The apparatus of claim 1 wherein the container and track are carried on a frame including collapsible legs for resting on a support surface.

* * * * *